US006527382B2

(12) United States Patent
Hou et al.

(10) Patent No.: US 6,527,382 B2
(45) Date of Patent: Mar. 4, 2003

(54) INK CONTAINER WITH IMPROVED INK FLOW

(75) Inventors: I-Chung Hou, Hsin-Chu (TW); Cheng-Wei Hsu, Yung-Kang (TW)

(73) Assignee: International United Technology Co., Ltd., Chu-Pei (TW)

( * ) Notice: Subject to any disclaimer, the term of this patent is extended or adjusted under 35 U.S.C. 154(b) by 0 days.

(21) Appl. No.: 09/682,943

(22) Filed: Nov. 2, 2001

(65) Prior Publication Data

US 2002/0163567 A1 Nov. 7, 2002

(30) Foreign Application Priority Data

May 2, 2001 (TW) ..... 90110549 A

(51) Int. Cl.[7] ..... B41J 2/175
(52) U.S. Cl. ..... 347/87
(58) Field of Search ..... 347/85, 86, 87

(56) References Cited

U.S. PATENT DOCUMENTS 6,042,225 A * 3/2000 Altendorf et al. ..... 347/87
6,276,785 B1 * 8/2001 Shinada et al. ..... 347/86

* cited by examiner

*Primary Examiner*—Michael Nghiem
(74) *Attorney, Agent, or Firm*—Winston Hsu

(57) ABSTRACT

An ink container includes a housing, a print head, and a fluid chamber. The housing has two inclined walls formed to divide the fluid chamber into a center ink well and two side ink wells. The housing also has two side walls, each having an inclined inner surface. The center ink well is formed between the two inclined walls. Each side ink well is formed between an inclined wall and a side wall. The inner surface of each side wall has a greater inclination than those of the inclined walls, so that each side ink well has a width decreasing from top to bottom.

1 Claim, 3 Drawing Sheets

3

INK CONTAINER WITH IMPROVED INK FLOW

BACKGROUND OF THE INVENTION

1. Field of the Invention

The present invention relates to an ink container, and more particularly, to an ink container with improved ink flow.

2. Description of the Prior Art

Please refer to FIG. 1. FIG. 1 is a sectional view of an ink container 10 according to U.S. Pat. 6,042,225. The ink container 10 comprises a housing 12, a print head 16, and an ink chamber 23 that is formed inside the housing 12 and includes a center ink well 22, and two side ink wells 24. Each one of the three ink wells 22, 24 is employed to store ink of one color in a porous member 26 such as a foam, which absorbs ink. The ink container 10 further comprises a center ink pipe 28 and two side ink pipes 32. The center ink pipe 28 fluidly connects the center ink well 22 and the print head 16. The side ink pipe 32 connects the side ink well 24 and the print head 16. A center filter 30 is horizontally installed on a top end of the center ink pipe 28 for filtering ink transmitted from the center inkwell 22, and each of two side filters 34 is vertically installed between the side ink well 24 and the corresponding side ink pipe 32 for filtering ink transmitted from the side ink well 24.

Due to a capillary attractive force, ink is kept inside the small hole of the porous member 26 such that the porous member 26 is able to absorb and store ink. This is equivalent to providing negative pressure inside the ink wells 22, 24, and the negative pressure force overcomes gravity acting on the ink, so as to reduce the fluid pressure inside the ink pipes 28,32. This prevents ink from leaking outside the print head, so that the printed document is not contaminated. However, on the other hand, if the capillary attraction is strong, the fluid pressure inside the ink pipes 28, 32 becomes too low to provide enough pressure for ejecting ink from the print head 16, so that print quality is affected. In a worst case, ink is locked in the ink wells 22, 24 and is unable to flow into the ink pipes 28,32.

In other words, the fluid pressure inside the ink pipe 28, 32 must be kept in a proper range, such that ink is ejected from the print head 16 when the print head 16 is printing and ink does not leak outside the print head 16 when the print head 16 is not printing.

According to the prior art, the side ink well 24 has a narrower top end (W3<W4), so that the top end of the porous member 26 is compressed more than its bottom end. This gives ink inside the side ink well 24 a trend to be pulled up and such a trend resists ink flowing from the top end to the bottom end.

SUMMARY OF THE INVENTION

It is therefore a primary objective of the present invention to provide an ink container that improves ink flow from top to bottom.

In a preferred embodiment, the present invention provides an ink container comprising a housing having two side walls, each side wall having an inner surface, a print head installed at a bottom of the housing for ejecting ink onto a document, and an ink chamber formed inside the housing having two inclined walls for dividing the ink chamber into a center ink well and two side ink wells. The center ink well is formed between the two inclined walls and has a width decreasing from top to bottom, each of the two side ink wells is formed between an inclined wall and a corresponding side wall. The inner surface of at least one of the side walls has a greater inclination than that of the corresponding inclined wall, so that the side ink well formed between the side wall and the inclined wall has a width decreasing from top to bottom.

The present invention further provides an ink container that comprises a housing having two side walls, a print head installed at a bottom of the housing for ejecting ink onto a document, snd an ink chamber formed inside the housing having two inclined walls for dividing the ink chamber into a center ink well and two side ink wells. The center ink well is formed between the two inclined walls and has a width decreasing from top to bottom. Each of the two side fluid wells is formed between an inclined wall and a corresponding side wall. The ink container further comprises a porous member positioned inside one of the side fluid wells for absorbing ink, and the porous member has a width increasing from top to bottom.

It is an advantage of the present invention that the bottom end of the porous member is compressed more than the top end, so as to improve ink flow from top to bottom.

These and other objectives of the present invention will no doubt become obvious to those of ordinary skill in the art after reading the following detailed description of the preferred embodiment which is illustrated in the various figures and drawings.

DETAILED DESCRIPTION

Figure 1:
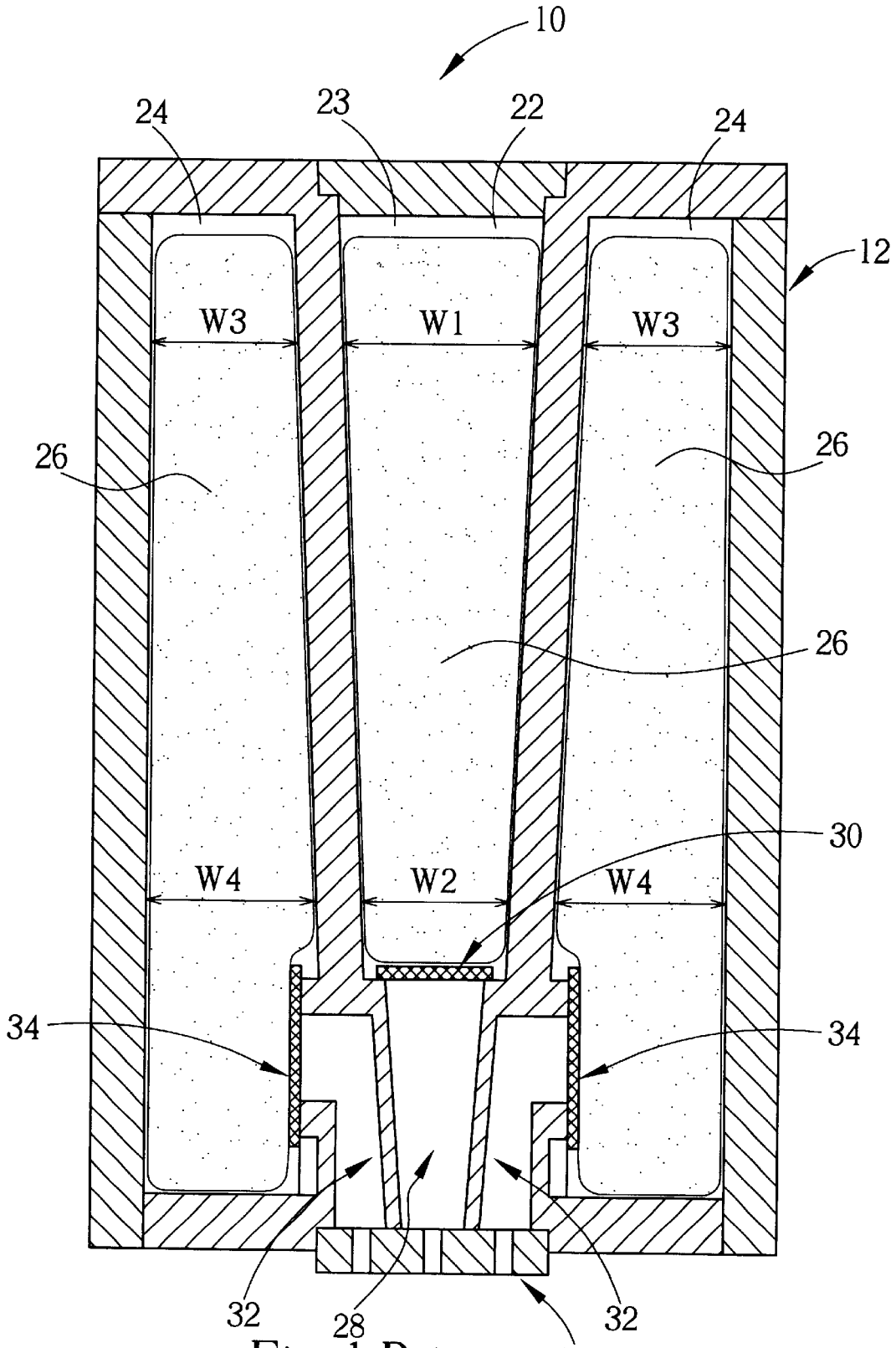
Fig. 1 Prior art
FIG. 1 is a sectional view of an ink container according to the prior art.
Figure 2:
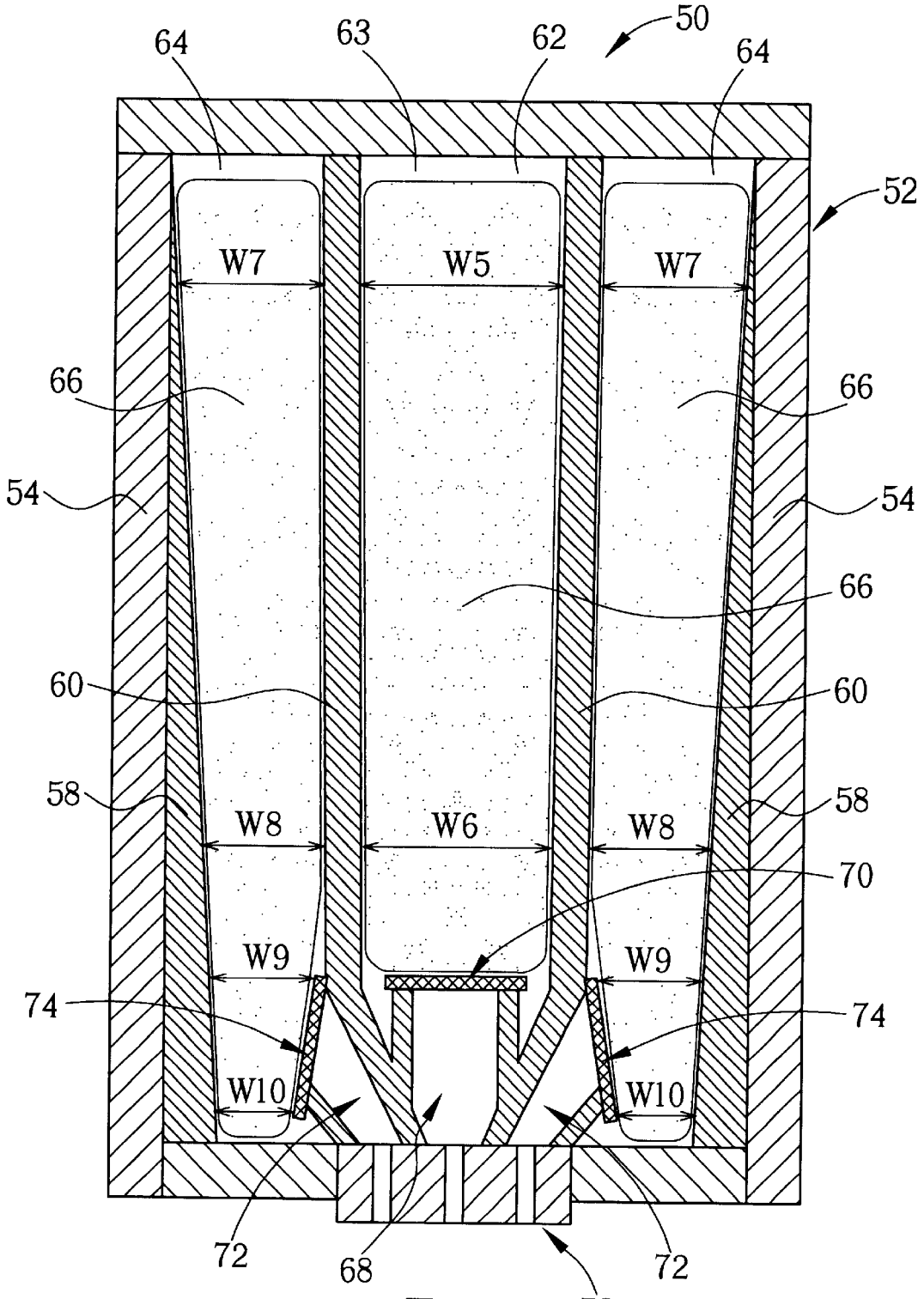
FIG. 2 is a sectional view of an ink container according to the present invention.

Please refer to FIG. 2. FIG. 2 is a sectional view of an ink container 50 according to the present invention. The ink container 50 comprises a housing 52 that has two side walls 54, each of which has an inner surface, a print head 56 that is installed at a bottom of the housing 52 for ejecting ink onto a document, and an ink chamber 63 that is formed inside the housing 52 and has two inclined walls 60 for dividing the ink chamber 63 into a center ink well 62 and two side ink wells 64. The center ink well 62 is formed between the two inclined walls 60 and has a width decreasing from top to bottom. Each of the two side ink wells 64 is formed between an inclined wall 60 and a corresponding side wall 54. The inner surface of at least one of the side walls 54 has a greater inclination than that of the corresponding inclined wall 60, so that the side ink well 64 has a width decreasing from top to bottom. Each of the three ink wells 62, 64 is employed to store one color of ink by way of a porous member 66, such as a foam that has a uniform width, to absorb ink.

The ink container 50 further comprises a center ink pipe 68 and two side ink pipes 72. The center ink pipe 68 fluidly connects the center ink well 62 and the print head 56. The side ink pipe 72 connects the side ink well 64 and the print head 56. A center filter 70 is horizontally installed on a top end of the center ink pipe 68 for filtering ink transmitted from the center ink well 62. Two side filters 74 are installed between the side ink well 64 and the corresponding side ink pipe 72, so that the width of the bottom portion of the side ink well 64 also decreases from top to bottom (W9>W10).

According to the present invention, the widths of the center ink well 62 and the side ink well 64 decrease from top to bottom, so that the bottom portion of the porous member 66 with uniform width is compressed more than the top portion. This causes ink inside the ink well to have a trend of being pushed down, and such a trend improves ink flow from the top end to the bottom end.

Please refer to FIG. 2 again, where the center ink well 62 with width decreasing from top to bottom (W5>W6) can be formed naturally in the molding process. Considering the side ink well 64, a rib 58 with width increasing from top to bottom is added to the inner face of the side wall 54 so as to form the side ink well 64 with width decreasing from top to bottom (W7>W8).

Figure 3:
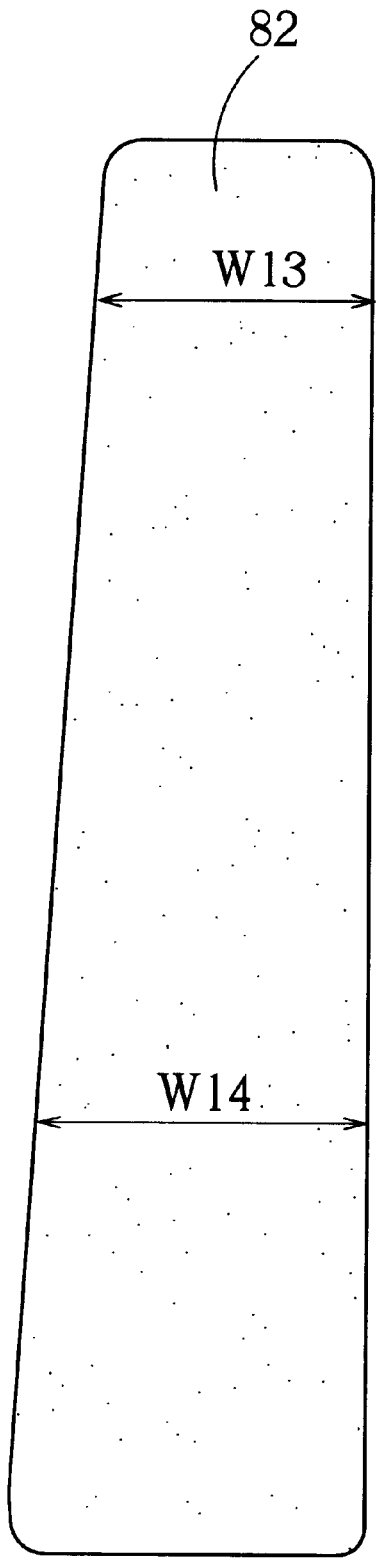
FIG. 3 is a perspective view of a porous member of an ink container according to a second embodiment.

Please refer to FIG. 3. FIG. 3 is a perspective view of the porous member 82 according to a second embodiment. An ink container used to contain the porous member shown in FIG. 3 is the same as the ink container 10. The only difference is the porous member 82 that is installed in the side ink well 24. The porous member 82 has a width increasing from top to bottom (W13<W14). Moreover, the width difference between top portions of the side ink well 24 and the porous member 66 is less than the width difference between bottom portions of the side ink well 24 and the porous member 82(W13−W3<W14−W4), such that the bottom portion of the porous member 82 is compressed more than its top portion. This also causes ink inside the ink well to exhibit a trend of being pushed down, and such a trend improves ink flow from the top end to the bottom end.

In contrast to the prior art, the present invention comprises the porous members 66, 82, whose top portions are compressed more than their bottom portions, so as to improve ink flow from top to bottom.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A fluid container comprising:

a housing having a first side wall and a second side wall;

a print head installed at bottom of the housing for injecting fluid onto a document;

a first side fluid well formed inside the housing, the first side fluid well being formed between the first side wall and a first inner wall;

a center fluid well formed inside the housing, the center fluid well being formed between the first inner wall and a second inner wall such that a width of the center fluid well continuously decreases from top to bottom;

a second side fluid well formed inside the housing, the second side fluid well being formed between the second inner wall and the second side wall; and a porous member positioned inside the first side fluid well for absorbing fluid inside the first side fluid well, the porous member having a width continuously increasing from top to bottom so that a bottom portion of the porous member is compressed more than a top portion of the porous member.

* * * * *